US009375859B2

(12) United States Patent
Weber

(10) Patent No.: US 9,375,859 B2
(45) Date of Patent: Jun. 28, 2016

(54) DEVICE FOR SLICING OF FOOD PRODUCTS

(71) Applicant: Weber Maschinenbau GmbH Breidenbach, Breidenbach (DE)

(72) Inventor: Günther Weber, Groß Nemerow (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 209 days.

(21) Appl. No.: 13/724,240

(22) Filed: Dec. 21, 2012

(65) Prior Publication Data

US 2013/0167700 A1 Jul. 4, 2013

(51) Int. Cl.

| | |
|---|---|
| ***B26D 7/01*** | (2006.01) |
| ***B26D 7/02*** | (2006.01) |
| ***B26D 7/06*** | (2006.01) |

(52) U.S. Cl.

CPC *B26D 7/01* (2013.01); *B26D 7/018* (2013.01); *B26D 7/02* (2013.01); *B26D 7/06* (2013.01); *B26D 7/0633* (2013.01); *B26D 2007/011* (2013.01); *B26D 2210/02* (2013.01); *Y10T 83/654* (2015.04); *Y10T 83/6542* (2015.04); *Y10T 83/6572* (2015.04); *Y10T 83/6656* (2015.04)

(58) Field of Classification Search

CPC ..... B26D 7/06; B26D 7/32; B26D 7/01; B26D 1/14; B26D 7/02; B26D 7/018; B26D 7/0633; A22C 17/02

USPC ..... 83/932, 435.15–435.19, 46, 469, 355, 83/92

See application file for complete search history.

(56) References Cited

U.S. PATENT DOCUMENTS

| | | | |
|---|---|---|---|
| 5,628,237 | A | 5/1997 | Lindee et al. |
| 6,769,337 | B2 | 8/2004 | Sandberg et al. |
| 2003/0221528 | A1 | 12/2003 | Sandberg et al. |

FOREIGN PATENT DOCUMENTS

| | | | |
|---|---|---|---|
| BE | 1012919 | A6 | 5/2001 |
| DE | 2550478 | A1 | 5/1977 |
| DE | 3543350 | A1 | 6/1987 |
| DE | 4230574 | A1 | 3/1994 |
| DE | 19801782 | A1 | 7/1999 |
| DE | 20218439 | U1 | 1/2003 |

(Continued)

OTHER PUBLICATIONS

Translation of EP 1424175A1, Nov. 21, 2003.*

(Continued)

*Primary Examiner* — Kenneth E. Peterson
*Assistant Examiner* — Nhat Chieu Do
(74) *Attorney, Agent, or Firm* — Quinn Law Group, PLLC

(57) ABSTRACT

An apparatus for slicing food products, in particular sausage, meat or cheese, includes a product support for at least one product, a cutting blade which is disposed after the product support and to which the product can be supplied along a conveying direction, and at least one product holder movable along the conveying direction and cooperating with the product at least at times during the slicing procedure, wherein the product support has a loading zone which is disposed between a starting position and an end position of the product holder and in which the product support can be loaded with the product and wherein the product holder is movable from the end position back into the start position while bypassing the loading zone.

8 Claims, 7 Drawing Sheets

(56) References Cited

FOREIGN PATENT DOCUMENTS

Figure 1:
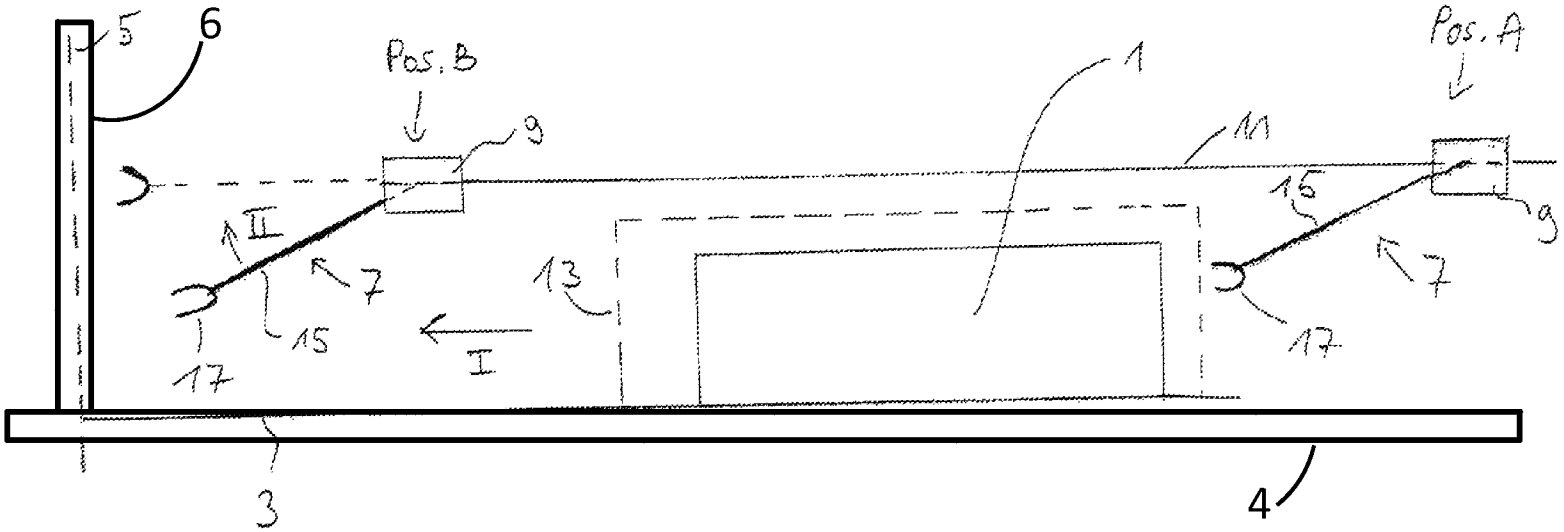

| | | | |
|---|---|---|---|
| DE | 102005013732 | A1 | 10/2006 |
| DE | 102005056848 | A1 | 5/2007 |
| DE | 602004009946 | T2 | 8/2008 |
| DE | 102008019984 | A1 | 10/2009 |
| DE | 102008020246 | A1 | 11/2009 |
| DE | 102010027126 | A1 | 1/2012 |
| EP | 1086789 | A1 | 3/2001 |
| EP | 1243366 | A1 | 9/2002 |
| EP | 1424175 | A1 * | 6/2004 |
| EP | 1704973 | A1 | 9/2006 |

OTHER PUBLICATIONS

Translation of DE 19801782, Jul. 22, 1999.*
DE19801782 and Translation of DE19801782, Sep. 9, 2015.*
Search Report dated Mar. 26, 2013 for corresponding EP application 12196406.8.
DE Search Report from Priority German Application No. 102011122069.4 Filed Dec. 22, 2011.

* cited by examiner

DEVICE FOR SLICING OF FOOD PRODUCTS

The present invention relates to an apparatus for slicing food products, in particular sausage, meat or cheese.

Apparatus for slicing food products, which are also known as slicing machines or slicers, are generally known. Such apparatus have a product support for at least one product to be sliced as well as a cutting blade which is disposed after the product support and to which the product can be supplied along a conveying direction. Furthermore, known apparatus of this kind are provided with a product holder movable along the conveying direction and cooperating with the product at least at times during the slicing procedure.

Although satisfactory results are achieved using the known product holders, the possibilities, in particular with respect to product throughput, product yield and cutting quality have not yet been fully exploited with the concepts currently being used. This is where the invention starts.

It is thus the underlying object of the present invention to provide an apparatus of the above-named kind which has an improved product holder and an improved concept for the use of a product holder to increase in particular the product throughput, the product yield and/or the cutting quality.

The object is satisfied in accordance with an aspect of the invention by an apparatus for slicing food products, in particular sausage, meat or cheese, having a product support for at least one product, a cutting blade which is disposed after the product support and to which the product can be supplied along a conveying direction, and at least one product holder movable along the conveying direction and cooperating with the product at least at times during the slicing procedure, wherein the product support has a loading zone which is disposed between a starting position and an end position of the product holder and in which the product support can be loaded with the product and wherein the product holder is movable from the end position back into the start position while bypassing the loading zone.

The product holder can be moved in the conveying direction, starting from its start position, and can be brought into contact with the product before the start of or only during the slicing procedure. The product can then be conveyed by the product holder and supplied to the cutting blade. The product holder can also only be moved with the product, without conveying the product, and can hold the product at its rear end, with the product being able to be conveyed in another manner, for example by means of a conveyor belt which forms the actual product support.

The product holder in every case after the end of the slicing procedure reaches its end position which is disposed behind the loading zone in the conveying direction and from which the product holder is moved back into its start position again while bypassing the loading zone. The product support can thereby be loaded with a new product—while the product holder is still being moved back into the start position. It is thus not necessary to wait until the product holder has passed through the loading zone to be able to reload the product support. The time span which elapses between the slicing of two products can thereby be shortened so that the product throughput is increased in the apparatus in accordance with the invention.

The term "product holder" is to be understood widely within the framework of the present invention. A device is in particular to be understood thereby which can be brought into contact with the product and/or by means of which the product can be handled in any manner. The product holder can also be a vacuum gripper. The product holder can, for example, be a product pusher which only conveys the product. The product can, for example, be moved in different directions by the product holder or forces can be exerted on the product using the product holder. The product holder preferably has a product gripper which can penetrate into the product, in particular into its rear section. The product is hereby firmly held. The functions "conveying" and "holding firmly" of the product holder can be realized individually or in combination depending on the application. The product can also be moved against the conveying direction by the product gripper. This may be desirable or necessary, for example, during the slicing procedure in order, for example, to carry out blank cuts. In addition, at the end of the slicing procedure, a rear product section, not sliced, can be moved away from the cutting blade against the conveying direction by means of the product gripper and can subsequently be thrown off into a remainder container.

The product holder is preferably movable to the side and/or upwardly and/or downwardly away from the end position. A bypassing of the loading zone can be implemented particularly simply from a construction aspect in this manner. In this respect, the product holder can be moved perpendicular to the conveying direction until it is located outside the loading zone. The product holder can subsequently be moved from the position reached in this manner against the conveying direction and past the loading zone back into the end position.

The product holder can be pivotable of foldable away from the end position. This can likewise be realized in a simple manner from a construction aspect. The pivoted away or folded away product holder can then be moved back past the loading zone into the start position.

The product holder can also be inwardly foldable or telescopic.

In accordance with a further aspect, the invention relates to an apparatus for slicing food products, in particular sausage, meat or cheese, having a product support for at least one product, a cutting blade which is disposed after the product support and to which the product can be supplied along a conveying direction, and at least one product holder movable along the conveying direction and cooperating with the product at least at times during the slicing procedure, wherein the product holder can be driven by means of a lever arrangement.

Higher maximum speeds for the movement of the product holder along the conveying direction can be achieved by such a lever drive in comparison with a known spindle and nut drive. It is in particular possible to move the product holder back into its start position again at a higher maximum speed after the slicing procedure than is possible with a spindle and nut drive, without disadvantages having to be accepted in the quality of the movement of the product holder in the conveying direction during the slicing procedure. The product holder thus reaches its start position in a shorter time than with conventional slicing apparatus. Waiting times between products to be sliced successively can thus be reduced, whereby the product throughput is increased.

The lever arrangement can be designed as a one-sided lever or as a two-sided lever, in particular as a lever in which the force arm is substantially shorter than the load arm. With a one-sided lever, the force arm and the load arm are on the same side with respect to the rotational axis of the lever, whereas with a two-sided lever, the rotational axis lies between the force arm and the load arm. The load arm corresponds to that side of the lever arrangement on which the load to be moved, that is the product holder, is located. The length of the load arm corresponds to the spacing of the point of engagement of the load from the rotational axis. The force arm corresponds to that side of the lever arrangement at which the moving force engages. The length of the force arm corresponds to the spacing between the rotational axis and the point of engagement of the moving force. If the force arm is substantially smaller than the load arm, the lever arrangement in accordance with the invention can effect a comparatively high speed at the load arm at a comparatively low speed at which the force arm is moved. A small rotational speed of the force arm, which can be achieved in a simple construction manner by means of an electrical drive unit, for example, can thus be converted into a comparatively high speed for the product holder coupled to the load arm due to the lever arrangement. The drive device can in particular engage at the rotational axis of the lever arrangement in accordance with the invention.

In accordance with a further development of the invention, the lever arrangement has a length compensation to compensate a spacing dependent on the position of the product holder along the conveying direction between the rotational axis of the lever arrangement and the product holder.

The length compensation can be implemented particularly simply in that the lever arrangement has at least two levers connected pivotally to one another since they change their relative alignment to one another via their pivotal connection and can thus compensate a changing spacing between the product holder and the rotational axis.

In a preferred embodiment, a drive unit for the lever arrangement is provided which is arranged beneath the product support. The drive unit can thereby be reached comparatively simply, for example, to carry out service work. In addition, the zone provided for handling the products above the product support is not hereby impaired.

In a preferred further development of the invention, a drive unit of the lever arrangement, for example an electric motor, engages at the rotational axis of the lever arrangement. On the one hand, a relatively simple rotational drive can hereby be implemented and, on the other hand, a comparatively high speed of the product holder can simultaneously be realized as desired—unlike with a spindle and nut arrangement.

The invention relates in accordance with a further aspect to an apparatus for slicing food products, in particular sausage, meat or cheese, having a product support for at least one product, a cutting blade which is disposed after the product support and to which the product can be supplied along a conveying direction, and at least one product holder movable along the conveying direction and cooperating with the product at least at times during the slicing procedure, wherein the spacing between the product holder and the product support is adjustable during the slicing procedure.

In particular a rear end section of the product which tapers toward the rear end can be held permanently in contact with the product support by the possibility of adjusting the spacing between the product holder and the product support when the rear end section is being sliced and is being held firmly—in whatever manner—by the product holder in so doing. The rear product end is hereby also supported by the product support, whereby the quality of the slices cut off from this end section is increased, which is what makes it possible at all, at least in specific applications, also to slice the rear product end, whereby the product yield is increased. In known apparatus, the tapering end section firmly held by the product holder hangs "in the air" so-to-say, so that a support by the product support is not present and the end section is either not sliced at all or is only sliced while accepting a lower cutting quality.

The control of the product holder with respect to its spacing from the product support can take place in accordance with a predefined profile or in dependence on the specific contour of the respective sliced product determined in any manner. A control unit for the product holder can be connected for this purpose to a detection device for the product contour.

The spacing between the product holder and the product support is preferably adjustable during the slicing procedure so that the product holder holds the product in contact with the product support during the slicing procedure.

The product holder can preferably be lowered for slicing the tapering rear end sections of the product such that the product holder holds the lower side of the rear end section in contact with the product support during the slicing procedure.

In a preferred embodiment of the invention, the product holder is pivotable for adjusting the spacing between the product holder and the product support. A variable product diameter can thus be compensated during the slicing of the end section by pivoting the product holder downwardly and the lower side of the end section can be permanently held in contact with the product support.

In accordance with a further aspect, the invention relates to an apparatus for slicing food products, in particular sausage, meat or cheese, having a product support for at least one product, a cutting blade which is disposed after the product support and to which the product can be supplied along a conveying direction, and at least one product holder movable along the conveying direction and cooperating with the product at least at times during the slicing procedure, wherein a guide device is provided in the region of the end of the product support facing the cutting blade which is configured to guide a rear end section of the product independently of the product holder.

It is hereby possible that the guide device "takes over" the product from the product holder toward the end of the slicing procedure and the product holder "retracts" in this respect so that the slicing of a rear product end can take place without any impairment by the product holder.

The product holder preferably has a product gripper having at least one gripping talon or claw which can penetrate into the rear end section of the product, whereby the product holder can grip the product and hold it firmly. To avoid a collision with the cutting blade, the rear product end has not previously been able to be sliced since the product holder engages into it. It becomes possible by the apparatus in accordance with the invention also to slice the rear end section since the product holder can be brought out of engagement with the end section and the end section can be supplied to the cutting blade in a controlled manner by the guide device independently of the product holder.

The end section can particularly easily be guided by a guide device which has a molded shell at least partly surrounding the product.

The guide device can have at least one conveying device to convey the product independently of the product holder. In this respect, the conveying device preferably has at least one conveyor belt which is preferably designed as an upper conveyor belt arranged above the product support.

A molded shell and a conveying device can be integrated components of an assembly of the guide device. In this manner, a molded shell having an integrated conveying function or a conveying device having an integrated guide function can be provided by the invention which allows a reliable and controlled slicing of a rear product remainder independently of the product holder.

The embodiments of the invention explained in the following can be realized in conjunction with any one of the above-named aspects of the invention.

The product support can have at least one lower conveyor belt for the product which forms a support surface for the product.

In a preferred further development of the invention, the product holder is arranged at a carrier which is guided along or in parallel with the conveying direction.

A plurality of products can be simultaneously supplied to the cutting blade in a plurality of parallel tracks disposed next to one another, with a product holder being provided for each product. A multi-track slicing of food products can thus be provided in which in particular the individual product holders can be operated independently of one another.

A common carrier which is guided along the apparatus is particularly preferably provided for the product holders.

Protection is claimed independently in each case for the above-named aspects of the invention, with protection additionally being respectively separately claimed for combinations of two or more of these aspects.

The invention furthermore relates to the methods set forth below for which protection is also claimed independently and in combination in each case.

In accordance with a method for slicing products, a product holder is moved from an end position back into a start position while bypassing a product loading zone in order already to bring the next product to be sliced into the loading zone during the movement back of the product holder.

In accordance with a further method for slicing products, a product holder driven by means of a lever arrangement is moved back into a start position at a speed which is substantially higher than a speed of the product holder provided during the slicing procedure.

In accordance with a further method for slicing products, the spacing of a product holder from a product support is varied during the slicing procedure, and indeed in accordance with a predefined profile and/or in dependence on determined product dimensions.

In accordance with a further method for slicing products, a guide device provided in the region of the cutting plane takes over a rear product end from a product holder active up to this takeover.

Figure 2:
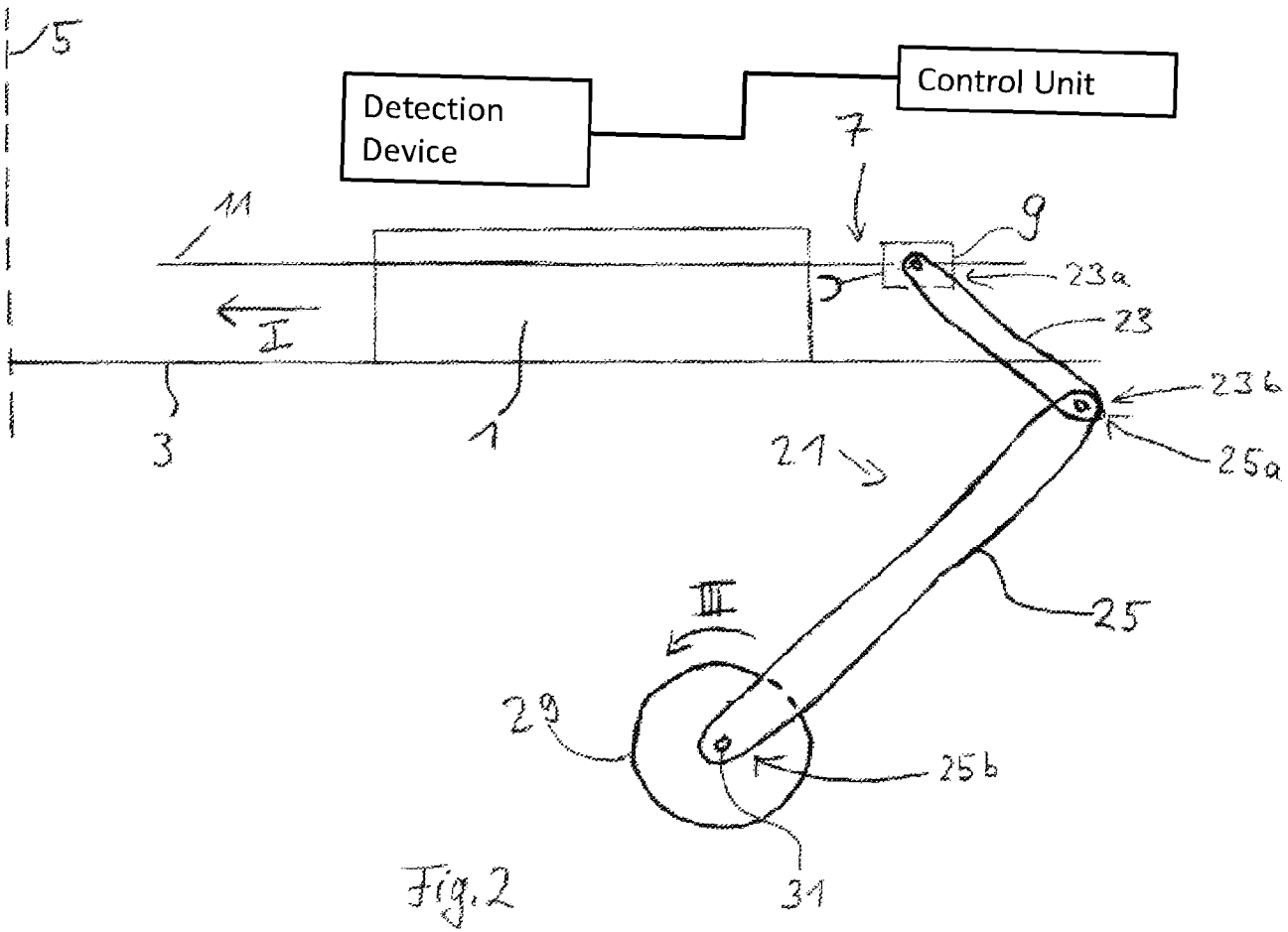
Figure 2A:
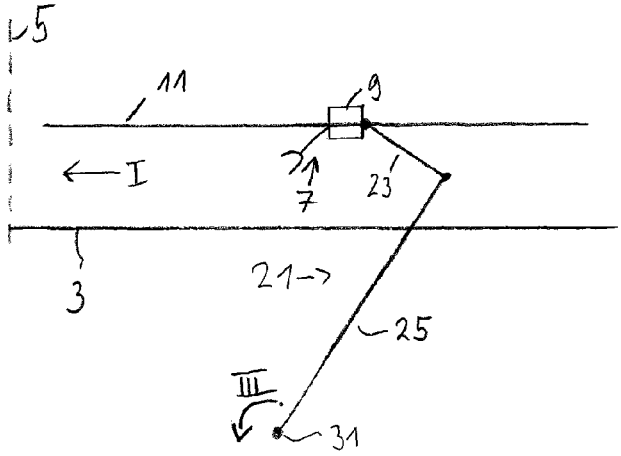
Figure 2B:
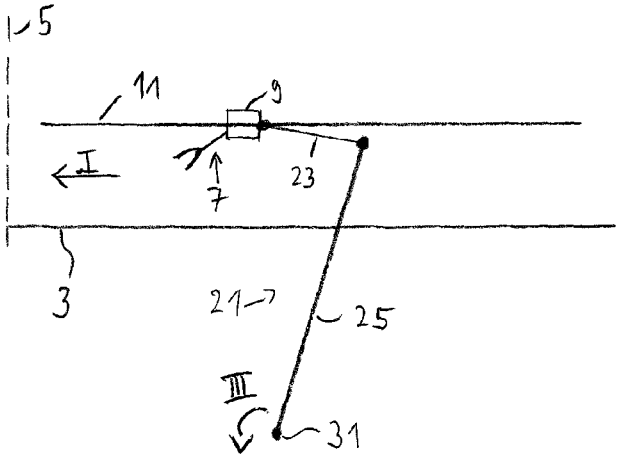
Figure 2C:
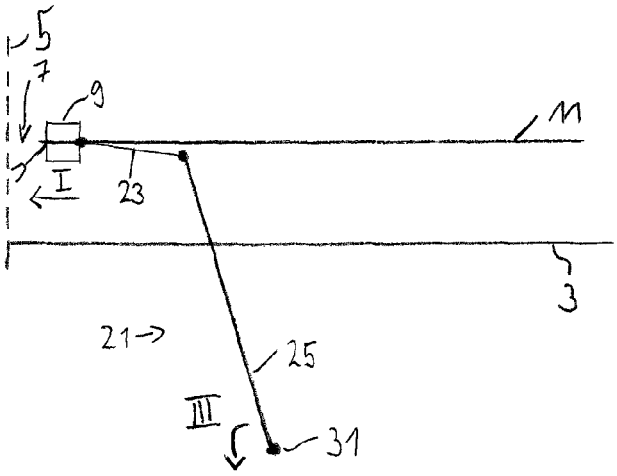
Figure 3:
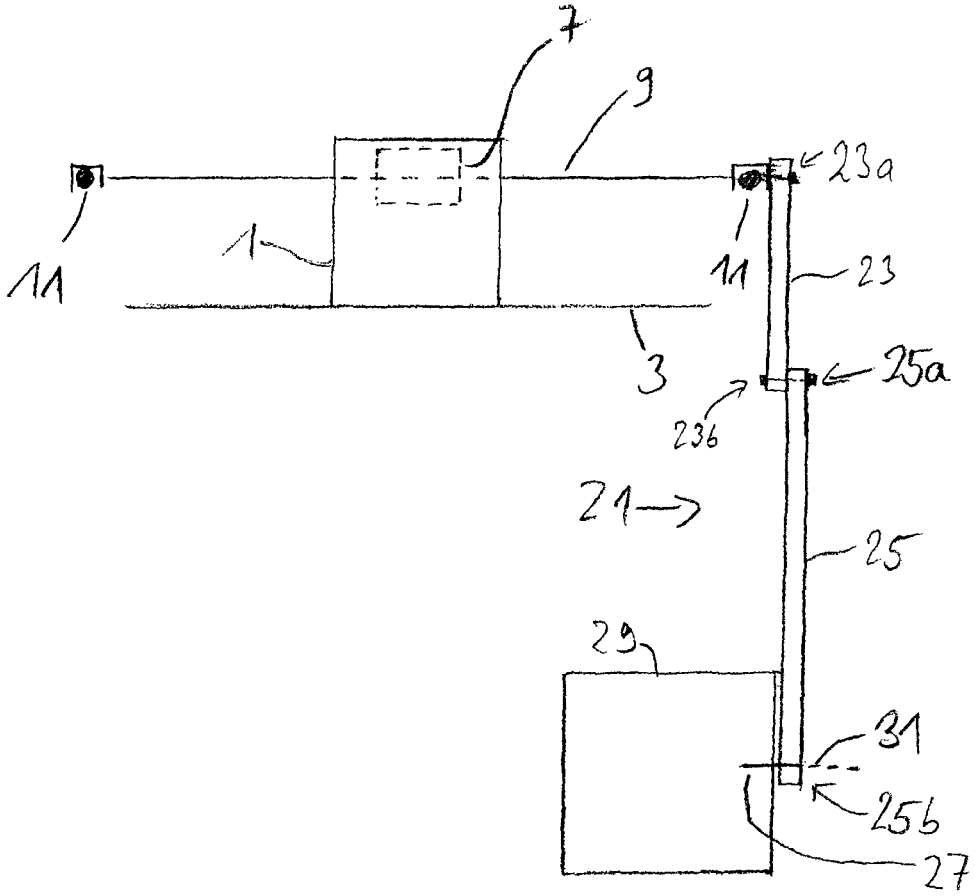
Figure 4:
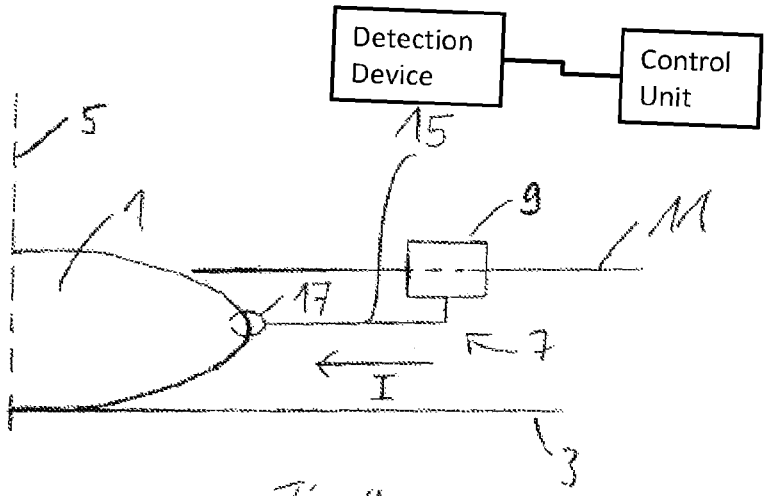
Figure 5:
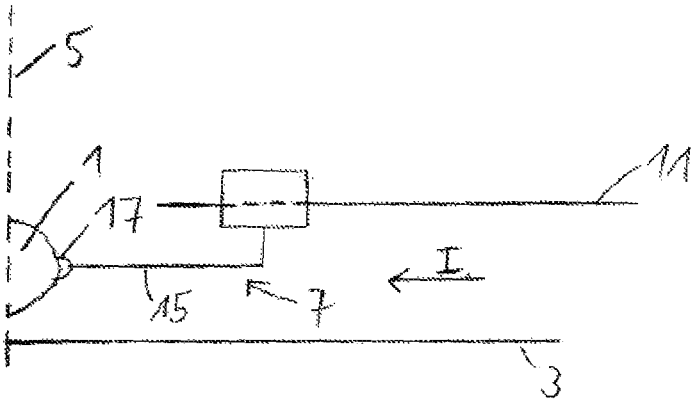
Figure 6:
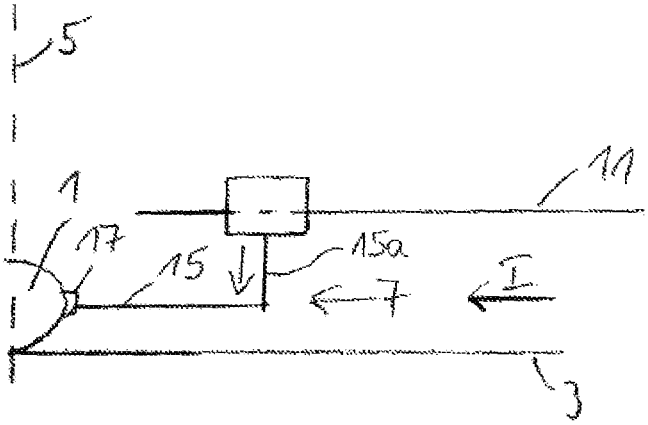
Figure 7:
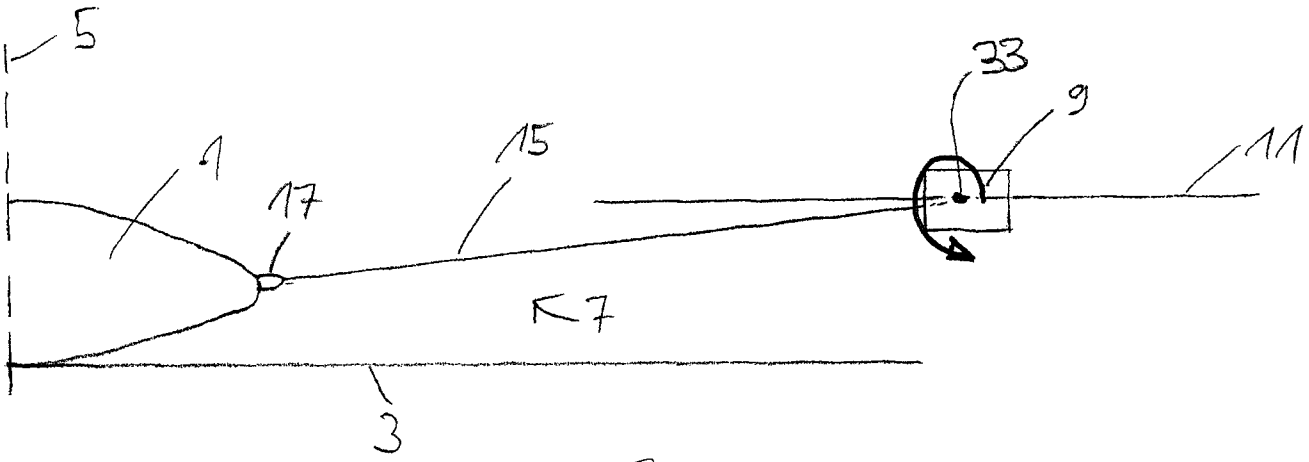
Figure 8:
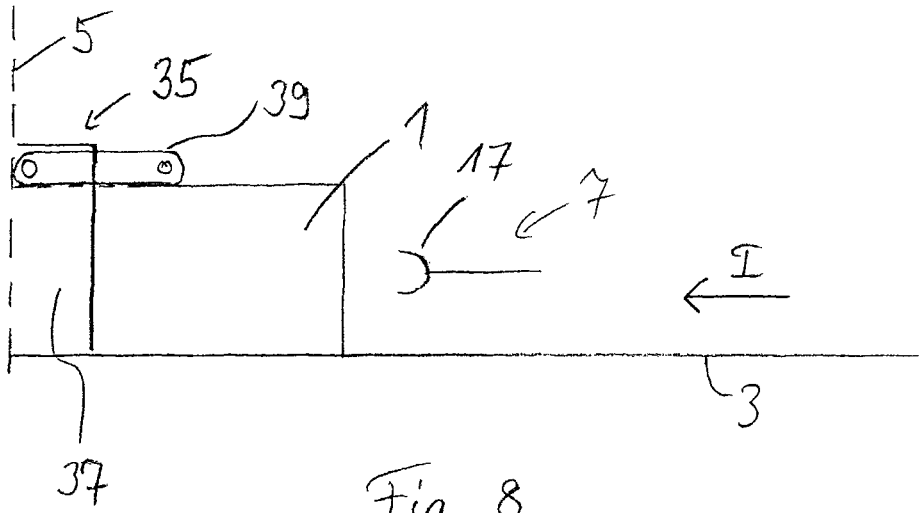
Figure 9:
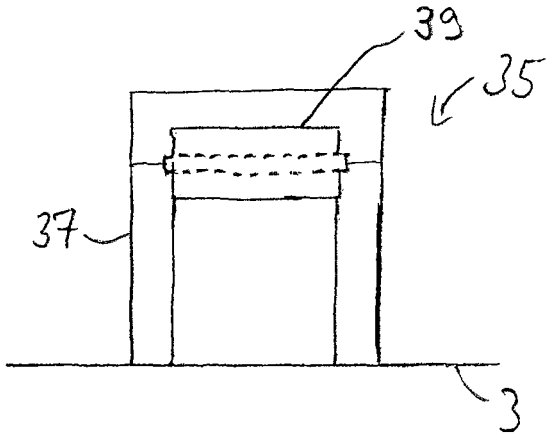

The invention will be explained in the following by way of example with reference to the enclosed drawing. There are shown, schematically in each case FIG. 1 a lateral view of an apparatus in accordance with the invention for slicing food products;

FIG. 2 a lateral view of an apparatus in accordance with the invention for slicing food products;

FIGS. 2A to C more schematic lateral views of the apparatus of FIG. 2;

FIG. 3 a front view of the apparatus of FIG. 2;

FIG. 4 a lateral view of a further apparatus in accordance with the invention for slicing food products;

FIG. 5 a lateral view of the apparatus of FIG. 4;

FIG. 6 a further lateral view of the apparatus of FIG. 4;

FIG. 7 a lateral view of a further apparatus in accordance with the invention for slicing food products;

FIG. 8 a lateral view of a further apparatus in accordance with the invention for slicing food products; and FIG. 9 a front view of the apparatus of FIG. 8.

The apparatus shown in FIG. 1 is provided for slicing a food product 1 and includes a product support 3 onto which the product 1 can be placed and can be conveyed along a conveying direction I. The apparatus has a cutting blade 6 which is arranged in a cutting plane 5 and which is disposed after the product support 3 in the conveying direction I. The cutting blade 6 can rotate about a blade axis in the cutting plane 5 and/or can orbit a center axis in a planetary motion to cut food slices off from the product 1 which fall onto a product support, not shown, from where the slices are transported on, in particular portion-wise.

The apparatus furthermore has a product holder 7 which is arranged at a carrier 9. The carrier 9 is movably supported at two guides 11 spaced apart from one another and extending laterally above the product support 3 and along the conveying direction I so that the product holder 7 is movable along the conveying direction I. The carrier 9 can, however, also only be movably supported at one or more mutually spaced apart guides 11 (not shown).

The product 1 is placed onto the product support 3 in a loading zone 13. The product 1 can, for example, be placed manually onto the product support 3 or can be pushed onto the product support 3 transversely to the conveying direction I by a placer, not shown, arranged laterally next to the loading zone 13.

In the apparatus of FIG. 1, the product holder 7 is moved in the conveying direction I from a start position (cf. pos. A in FIG. 1) in which the product holder 7 is located behind the loading zone 13 and is brought into engagement with the rear end section of the product 1 remote from the cutting blade 6. For this purpose, the product holder 7 has a product gripper 17 which is arranged at a product holder arm 15 end at which at least one gripper claw is arranged which can penetrate into and the rear end section of the product 1 and thus grip and hold firm the product 1.

The product 1 can be conveyed in the conveying direction I and supplied to the cutting blade 6 by means of the product holder 7. In this respect, the product holder 7 is moved through the loading zone 13. After it has been brought out of engagement with the product 1 or after the slicing procedure for the product 1 has been ended, the product holder 7 reaches an end position (cf. pos. B in FIG. 1) which is disposed behind the loading zone 13 viewed in the conveying direction I.

Provision is made in accordance with the invention that the product holder 7 can be moved from the end position B again while bypassing the loading zone 13 back into the start position A. Since the product holder 7 is thus not moved back into the start position A through the loading zone 13, it is possible to load the product support 3 with a new product in the loading zone 13 while the product holder 7 is still being moved back into the start position A. It can thereby be achieved, for example, that the new product 1 is already lying on the product support 3 while the product holder 7 is moving back into the start position A. The product holder 7 thus does not have to wait at the start position A until the new product 1 is ready, but can rather immediately again be moved out of the start position A in the conveying direction 1 to the new product 1. The time period within which two products can be sliced after one another can thus be shortened by the invention.

As is shown in FIG. 1, in the apparatus shown by way of example here, the loading zone 13 is bypassed in that the product holder arm 15 is pivoted upwardly in the pivot direction II into the position shown dashed with a product holder 7 located in the end position B. The product holder 7 is thus flipped upward and subsequently moved back into the start position A above the loading zone 13.

The upward pivot movement of the product holder 7 in the pivot direction II is only set forth as an example. Alternatively or additionally, the product holder 7 can, for example, be moved away to the side and moved laterally past the loading zone 13 into the start position A.

The "pivoting away" or "folding away" of the product holder 7 only represents one of a plurality of possibilities to be able to move the product holder 7 past the loading zone 13 back into the start position A. In accordance with other variants, not shown, the product holder 7, in particular the product holder arm 15, is foldable or telescopic so that the product holder 7 or its arm 15 can be moved back past the loading zone 13 into the start position A in the folded together or retracted state.

In the apparatus shown here, the product 1 is not only firmly held by the product holder 7, but rather also conveyed by it. Alternatively or in addition, the product support 3 can have a conveyor belt 4 which forms the actual support surface for the product 1 and by means of which the product 1 can be conveyed along the conveying direction I. The product holder 7 can then convey the product 1 in addition to the conveyor belt 4 or also only be moved with the product 1, without the product 1 being conveyed by the product holder 7. In the latter case, the product holder 7 can be used to stabilize the product 1 by holding firmly at the rear product end and/or to move it against the conveying direction I as required, that is to move it away from the cutting plane 5, for example to carry out blank cuts or to supply the rear end section of the product to a remainder container if it is not sliced.

For the case that the actual product supply to the cutting blade 6 takes place by the mentioned conveyor belt 4 of the product support 3, it is also not necessary that the product holder 7 engages from the start into the rear end section of the product 1. The slicing of the product 1 can rather already be started before the product holder 7 is brought into engagement with the rear end section.

It is essential in the apparatus in accordance with the invention that the product holder 7 can move back into the start position A while bypassing the loading zone 13 so that the product support 3 can be loaded with a further product 1 to be sliced still during the moving back of the product holder 7.

In the apparatus shown in FIGS. 2, 2A to 2C and 3, the product holder 7 can be driven by means of a lever arrangement 21. The lever arrangement 21 includes a first lever 23 and a second lever 25. A first end 23*a* of the first lever 23 is pivotally connected to a carrier 9 which is displaceable alone a guide 11. The second end 23*b* of the first lever 23 is pivotally connected to a first end 25*a* of the second lever 25. The second end 25*b* of the second lever 25 is coupled to an output shaft 27 of a drive unit 29 which is arranged beneath the product support 3 and which is in particular an electric motor.

The second lever 25 can be rotated about a rotational axis 31 extending through the drive shaft 27. As can be seen in FIGS. 2A, 2B and 2C, the arrangement of the levers 23, 25 and their lengths are selected so that, on a rotation of the second lever 25 in the direction of rotation III, the first lever 23 acts on the carrier 9 such that it is moved together with the product holder 7 along the guide 11 in the conveying direction I. The carrier 9 and the product holder 7 are moved against the conveying direction I by the first lever 23 by a rotation of the second lever 25 against the direction of rotation III.

The two levers 23, 25 can alter their relative alignment to one another by the pivotal connection between the two levers 23, 25. The lever arrangement 21 thus has a length compensation to compensate a spacing between the rotational axis 31 and the product holder 7 dependent on the position of the product holder 7 along the conveying direction I.

As mentioned, the second lever 25 can be rotated about the rotational axis 31 extending through the drive shaft 27. In this respect, the drive unit 29 engages at the rotational axis 31 so that the force arm of the lever arrangement 21 is very short or so that a triggering torque is present. In contrast, in the lever arrangement 21 the load arm which extends from the rotational axis 31 up to the moving load and thus up to the first end 23*a* of the first lever 23 is comparatively long. The product holder 7 thereby reaches a comparatively high speed in the conveying direction I even with a small rotational speed of the drive shaft 27.

In the apparatus in accordance with the invention, the product holder 7 can therefore move as required at a comparatively high speed along the conveying direction I. This is in particular utilized after the slicing of the product 1 to move the production holder 7 back into its start position. The product holder 7 thus again reaches its start position in a relatively short time and can subsequently again be used for slicing a new product 1 brought onto the product support 3. The time period can thus be shortened which elapses between the slicing of successive products 1, and consequently the product throughput of the apparatus can be increased.

A slicing apparatus in accordance with the invention will be described with reference to FIGS. 4 to 6 in which the spacing between the product holder 7 and the product support 3 is adjustable—while the product 1 is being sliced. This is in particular of advantage during the slicing of a tapering rear end section of the product 1, which will be explained in more detail in the following.

A situation is shown in FIG. 4 in which the tapering rear end section of the product 1 is not yet sliced. The lower side of the product 1 lies on the product support 3 so that the cutting off of product slices by means of the cutting blade 6 (FIG. 1) can take place at high cutting quality since the product 1 is not only held firmly by the product holder 7 at its rear end, but is also additionally supported by the product support 3 in the region of the cutting plane 5.

If the spacing of the product holder 7 from the product support 3 cannot be adjusted, the problem illustrated in FIG. 5 can occur during the slicing of the rear end section of the product 1. Since the product gripper 17 engages into the rear end section of the product 1, it is held firmly and hangs "in the air" so-to-say as soon as the tapering end section moves into the cutting plane 5, that is the product 1 no longer lies on the product support 3 due to its tapered end still held by the product holder 7 at the previous spacing from the product support 3. This lack of support by the product support 3 can result in a deterioration of the cutting results.

Provision is now made in the apparatus in accordance with the invention that the spacing between the product holder 7 and the product support 3 is set during the slicing procedure by lowering the product holder 7 such that the product 1 is permanently held in contact with the product support 3 (cf. FIG. 6). The product 1 including the tapering end section can thereby be sliced continuously with constant quality. The rejects can thus be reduced and the product yield increased.

As shown by way of example in FIG. 6, the product holder 7 can be lowered in that the product holder arm 15 has a section 15*a* which can be moved out downwardly. In contrast, an alternative embodiment is shown in FIG. 7 in which the spacing between the product holder 7 and the product support 3 is adjustable during the slicing procedure such that the comparatively long product holder arm 15 can be pivoted downwardly about a pivot axis 33. The end section of the product 1 can likewise be permanently held in contact with the product support 3 during the slicing procedure by downwardly pivoting the product holder arm 15 and the product gripper 17 arranged thereat.

As was already stated above, the product holder 7 can have a product gripper 17 having at least one gripper claw which can engage into the rear end section of the product 1. The gripping claw can e.g. have hooks or needles. When the gripping claw engages into the rear end section of the product 1, it cannot be sliced completely since the cutting blade 6 would collide with the gripping claw.

Provision is now made in the embodiment described with respect to FIGS. 8 and 9 that the product gripper 17 is brought out of engagement with the rear end section of the product 1 toward the end of the slicing procedure in order subsequently to be able to slice the rear end section without a collision between the cutting blade 6 and the gripping claw having to be feared.

To supply the end section of the product 1 to the cutting blade 6 in a controlled manner independently of the product holder 7, a guide device 35 is provided in the region of the end of the product support 3 facing the cutting plane 5 in the slicing apparatus of FIGS. 8 and 9, with the rear end section of the product 1 being able to be supplied to the cutting blade 6 by said guide device—after the product gripper 17 has been retracted from the product 1. In this respect, the guide device 35 includes a molded shell 37 which is adapted to the cross-sectional shape of the respective product 1 and by which the product 1 is at least partly surrounded and guided in the peripheral direction. The molded shell 37 can thus be considered as a slot in which the product 1 is guided.

The lower region of the molded shell 37 forms the front end of the product support 3 and thus the cutting edge which cooperates with the cutting blade 6 during the slicing and which is also called a counter-blade.

The guide device 35 moreover includes an upper conveyor belt 39 whose spacing from the product support 3 can be adjusted and thus adapted to the diameter of the product 1. The product 1 can be conveyed and supplied to the cutting blade 6 by the upper conveyor belt 39 independently of the product holder 7 and/or of a conveyor belt 4 of the product support 3, which conveyor belt 4 forms the actual support surface for the product 1.

It is therefore possible in the embodiment described with reference to FIGS. 8 and 9 to slice the end section of the product 1 completely. The product yield can thereby be correspondingly increased.

REFERENCE NUMERAL LIST

1 food product
3 product support
5 cutting plane
7 product holder
9 carrier
11 guide
13 loading zone
15 product holder arm
15*a* section of the product holder arm
17 product gripper
21 lever arrangement
23 first lever
23*a* first end
23*b* second end
25 second lever
25*a* first end
25*b* second end
27 drive shaft
29 drive unit
31 rotational axis
33 pivot axis
35 guide device
37 molded shell
39 conveyor band
I conveying direction
II pivot direction
III direction of rotation

The invention claimed is:

1. An apparatus for slicing food products, comprising:

a product support for at least one product;

a cutting blade which is disposed after the product support and to which the product can be supplied along a conveying direction; and at least one product holder movable along the conveying direction and cooperating with the product at least at times during a slicing procedure, wherein the spacing between the product holder and the product support is adjustable during the slicing procedure;

wherein the spacing is adjustable such that the product holder holds the product in contact with the product support during the slicing procedure;

wherein the product holder is configured to be lowered for slicing a tapering rear end section of the product such that the product holder holds a lower side of the tapering rear end section of the product in contact with the product support during the slicing procedure;

a control unit for the product holder; and a detection device for a product contour, wherein the control unit is connected to the detection device, and the control unit is adapted to control the product holder in accordance with a detected product contour of the product such that the spacing between the product holder and the product support is adjusted during the slicing procedure to hold the product in contact with the product support.

2. The apparatus in accordance with claim 1, wherein the product holder is configured for firmly holding the product at the tapering rear end section of the product.

3. The apparatus in accordance with claim 2, wherein the product holder is designed in a hook shape or as a vacuum gripper.

4. The apparatus in accordance with claim 1, wherein the product holder is pivotable between the product holder and the product support for adjusting the spacing.

5. The apparatus in accordance with claim 1, wherein the product support has at least one lower conveyor belt for the product which forms a support surface for the product; or wherein the product holder has a product gripper which can penetrate into the product; wherein the product holder is arranged at a carrier which is guided along the conveying direction; or wherein a plurality of products can be supplied simultaneously, with a product holder being provided for each product; or wherein the product holders being able to be operated independently of one another; or wherein a common carrier is provided for the product holders which is guided along the conveying direction, with the product holders in particular being movable relative to the carrier independently of one another.

6. The apparatus in accordance with claim 1, wherein the product support has a loading zone which is disposed between a start position and an end position of the product holder and in which the product support can be loaded with the product, and wherein the product holder is movable from the end position back into the start position while bypassing the loading zone.

7. The apparatus in accordance with claim 1, wherein the product holder can be driven by means of a lever arrangement.

8. The apparatus in accordance with claim 1, wherein a guide device is provided in a region of an end of the product support facing the cutting blade, said guide device being configured to guide the tapering rear end section of the product independently of the product holder.

* * * * *